US007353960B2

(12) United States Patent
Seiter

(10) Patent No.: US 7,353,960 B2
(45) Date of Patent: Apr. 8, 2008

(54) CARGO CONTAINER WITH INSULATED FLOOR

(75) Inventor: Joseph Seiter, Raleigh, NC (US)

(73) Assignee: Martin Marietta Materials, Inc., Raleigh, NC (US)

( * ) Notice: Subject to any disclaimer, the term of this patent is extended or adjusted under 35 U.S.C. 154(b) by 274 days.

(21) Appl. No.: 10/957,729

(22) Filed: Oct. 5, 2004

(65) Prior Publication Data

US 2006/0070548 A1 Apr. 6, 2006

(51) Int. Cl.
*B65D 88/00* (2006.01)
*B61D 3/00* (2006.01)
*B61D 17/00* (2006.01)

(52) U.S. Cl. ..... 220/1.5; 105/355; 105/404

(58) Field of Classification Search ..... 220/1.5; 105/404, 355
See application file for complete search history.

(56) References Cited

U.S. PATENT DOCUMENTS

| | | | |
|---|---|---|---|
| 739,800 | A | 9/1903 | Adams |
| 905,000 | A | 11/1908 | Roberts |
| 1,127,451 | A | 2/1915 | Knoch |
| 1,269,663 | A | 6/1918 | Wappler |
| 3,711,148 | A | 1/1973 | Hindin |
| 3,715,846 | A | 2/1973 | Sullhofer |
| 3,739,526 | A | 6/1973 | Nelson |
| 3,797,190 | A | 3/1974 | Widdowson |
| 3,802,591 | A | 4/1974 | Mizushima et al. |
| 3,880,415 | A | 4/1975 | Fujioka et al. |
| 3,962,015 | A | 6/1976 | Heimann |
| 3,974,781 | A | 8/1976 | Josephson |
| 3,993,811 | A | 11/1976 | Walles |
| 4,049,311 | A | 9/1977 | Dietrich et al. |
| 4,078,395 | A | 3/1978 | Crowe et al. |
| 4,091,743 | A | 5/1978 | Lemon |
| 4,151,802 | A | 5/1979 | Miller et al. |
| 4,221,421 | A | 9/1980 | Bettker, Jr. et al. |
| 4,239,008 | A | 12/1980 | Conlon |
| 4,263,751 | A | 4/1981 | Bennett et al. |
| 4,296,692 | A | 10/1981 | Roux |
| 4,302,913 | A | 12/1981 | Schwartz et al. |
| 4,310,192 | A | 1/1982 | Fitzgerald |
| 4,344,299 | A | 8/1982 | Latzer |
| 4,357,048 | A | 11/1982 | Zehnder et al. |
| 4,406,131 | A | 9/1983 | Weasel, Jr. |
| 4,434,623 | A | 3/1984 | Weasel, Jr. |
| 4,448,041 | A | 5/1984 | Southworth, Jr. |
| 4,454,723 | A | 6/1984 | Weasel, Jr. |
| 4,455,806 | A | 6/1984 | Rice |
| 4,498,418 | A | 2/1985 | Chumley |
| 4,569,292 | A | 2/1986 | Dunham et al. |
| 4,570,396 | A | 2/1986 | Struben |
| 4,631,891 | A | 12/1986 | Donavich |
| 4,646,934 | A | 3/1987 | McAllister |
| 4,682,458 | A | 7/1987 | Sparrow |

(Continued)

FOREIGN PATENT DOCUMENTS

| | | |
|---|---|---|
| EP | 0 006 443 A1 | 9/1980 |

(Continued)

OTHER PUBLICATIONS

U.S. Appl. No. 11/104,089, filed Apr. 12, 2005, Zupancich et al.

(Continued)

*Primary Examiner*—Anthony D. Stashick
*Assistant Examiner*—Shawn M. Braden
(74) *Attorney, Agent, or Firm*—Finnegan, Henderson, Farabow, Garrett & Dunner LLP

(57) ABSTRACT

The present invention relates to an insulated cargo container with an insulated floor. The insulated floor includes insulating members and insulation layers in order to remove thermal shorts and increase the thermal efficiency of the cargo container.

2 Claims, 6 Drawing Sheets

U.S. PATENT DOCUMENTS 4,704,876 A 11/1987 Hill
4,763,452 A 8/1988 Harvey
4,778,078 A 10/1988 McAllister
4,791,768 A 12/1988 Crean
4,884,496 A 12/1989 Donavich
4,887,437 A 12/1989 Fenton et al.
4,891,954 A 1/1990 Thomsen
4,918,895 A 4/1990 Landheer
4,958,472 A 9/1990 Ehrlich
5,010,943 A 4/1991 Boyer
5,011,729 A 4/1991 McAllister
5,016,395 A 5/1991 Walker et al.
5,054,402 A 10/1991 Brassell
5,054,843 A 10/1991 Gray
5,168,717 A 12/1992 Mowatt-Larssen
5,170,605 A 12/1992 Huddle
5,285,604 A 2/1994 Carlin
5,316,171 A 5/1994 Danner, Jr. et al.
5,351,990 A 10/1994 Thomas
5,403,063 A 4/1995 Sjostedt et al.
5,473,901 A 12/1995 Roseen
5,500,305 A 3/1996 Bridges et al.
5,507,405 A 4/1996 Thomas et al.
5,512,345 A 4/1996 Tsutsumi et al.
5,584,188 A 12/1996 Tippmann et al.
5,660,057 A 8/1997 Tyree, Jr.
5,664,396 A 9/1997 Lyman et al.
5,671,609 A 9/1997 Lionetti
5,711,073 A 1/1998 Tippmann et al.
5,756,179 A 5/1998 Jutte
5,765,485 A 6/1998 Thoman et al.
5,772,276 A 6/1998 Fetz et al.
5,784,970 A 7/1998 Fehr et al.
5,795,639 A 8/1998 Lin
5,797,646 A 8/1998 Jeunehomme et al.
5,802,984 A * 9/1998 Thoman et al. ..... 105/404
5,855,174 A 1/1999 Thoman et al.
5,857,414 A 1/1999 Thoman et al.
5,890,435 A 4/1999 Thoman et al.
5,900,299 A 5/1999 Wynne
5,916,093 A 6/1999 Fecko et al.
5,927,090 A 7/1999 Ladendorf et al.
5,934,741 A 8/1999 Beukers et al.
5,938,274 A 8/1999 Ehrlich
5,947,812 A 9/1999 Henning et al.
5,979,173 A 11/1999 Tyree
5,979,684 A 11/1999 Ohnishi et al.
5,988,074 A 11/1999 Thoman
5,992,117 A 11/1999 Schmidt
6,000,342 A 12/1999 Thoman et al.
6,010,020 A 1/2000 Abal
6,037,033 A 3/2000 Hunter
6,092,472 A 7/2000 Thoman et al.
6,119,422 A 9/2000 Clear et al.
6,132,307 A 10/2000 Wills
6,138,580 A * 10/2000 Thoman ..... 105/396
6,199,939 B1 3/2001 Ehrlich
6,220,651 B1 4/2001 Ehrlich
6,224,142 B1 5/2001 McCormack
6,244,458 B1 6/2001 Frysinger et al.
6,266,972 B1 7/2001 Bostic
6,269,652 B1 8/2001 Grosskopf
6,349,988 B1 2/2002 Foster et al.
6,367,391 B1 4/2002 Thoman et al.
6,374,546 B1 4/2002 Fecko et al.
6,381,966 B1 5/2002 Barrow
6,381,981 B1 5/2002 Yaddgo et al.
6,397,620 B1 6/2002 Kelly et al.
6,454,345 B1 9/2002 Campus
6,503,037 B2 1/2003 Thomson et al.
6,505,883 B1 1/2003 Ehrlich
6,550,255 B2 4/2003 Rudick et al.
6,615,741 B2 9/2003 Fecko et al.
6,623,413 B1 9/2003 Wynne
6,722,287 B2 4/2004 Norton et al.
2001/0011832 A1 8/2001 Ehrlich et al.
2002/0020129 A1 2/2002 Winter
2002/0062611 A1 5/2002 Pryor et al.
2002/0114937 A1 8/2002 Albert et al.
2002/0134088 A1 9/2002 Rudick et al.
2002/0144482 A1 10/2002 Henson et al.
2002/0148181 A1 10/2002 Friesner
2002/0148196 A1 10/2002 Barry et al.
2002/0148381 A1 10/2002 Norton et al.
2002/0157565 A1 10/2002 Norton et al.
2002/0170238 A1 11/2002 Fecko et al.
2002/0185880 A1 12/2002 Miller
2003/0041981 A1 3/2003 Cramer, III
2003/0056456 A1 3/2003 Heydon
2003/0159404 A1 8/2003 Chang
2003/0203149 A1 10/2003 Allen et al.
2004/0020236 A1 2/2004 Vince, II et al.
2005/0076805 A1* 4/2005 Creighton et al. ..... 105/404
2005/0087096 A1* 4/2005 Creighton et al. ..... 105/355

FOREIGN PATENT DOCUMENTS

EP 0 052 982 A2 6/1982
EP 0 075 913 A2 4/1983
EP 0 330 293 A2 8/1989
EP 0 375 621 A1 12/1989
EP 0 358 638 B1 3/1990
EP 0 490 073 B1 12/1990
EP 0 463 980 B1 1/1992
EP 0 514 014 B1 11/1992
EP 0 544 361 B1 6/1993
EP 0 589 033 B1 3/1994
EP 0 739 800 A1 10/1996
EP 0 753 422 B1 1/1997
EP 0 904 228 B1 3/1999
EP 0 905 000 A1 3/1999
EP 0 962 343 A2 12/1999
EP 0 967 116 A2 12/1999
EP 1 219 484 A2 7/2002
EP 1 288 112 A1 3/2003
JP 55135294 10/1980
JP 1127451 5/1989
JP 1269663 10/1989
JP 9048369 2/1997
JP 10-147262 6/1998
JP 10-258777 9/1998
JP 10-258779 9/1998
JP 10258778 9/1998
JP 11-210106 8/1999
JP 2000-052982 2/2000
JP 2000-081266 3/2000
JP 2001263897 9/2001
JP 2002-264717 9/2002
WO PCT/WO99/10220 3/1999
WO PCT/WO99/12787 3/1999
WO WO 0006443 2/2000
WO WO 2004/071885 8/2004

OTHER PUBLICATIONS

U.S. Appl. No. 11/072,293, filed Mar. 7, 2005, Zupancich et al.
"Qualification Testing of Portland's Low Floor Light Rail Vehicle", Porter, D.L. et al., Proceedings of the 1997 IEEE/ASME Joint Railroad Conference, p. 221-35 (1997).
"Fiberglass Reinforced Foam Core Sandwich Panel for Use as Refrigerated Semi-Trailer Side Walls and Roofs", Edford, Allan S., SAE Technical Papers, 820991, (1982).

* cited by examiner

CARGO CONTAINER WITH INSULATED FLOOR

I. BACKGROUND

A. Technical Field

The present invention relates to a cargo container with an insulated floor. In one embodiment, the cargo container is a railroad boxcar.

B. Related Art

Currently, many shippers utilize refrigerated and/or insulated large cargo containers (such as boxcars) to transport items that require the maintenance of specified temperatures during transit. Because these containers are required to maintain certain temperatures, the thermal efficiency of these containers is an important feature. Thermal efficiency is characterized by the thermal conductivity of a particular component or its inverse, its resistance to heat transfer, commonly referred to as an R-value.

In these containers, a significant amount of heat loss occurs through the floor or other places with thermal shorts. A typical container floor is constructed of metal, which is highly conductive to heat transfer. Since the underside of the floor is exposed to ambient conditions, the conductive properties of the metal floor cause heat loss through the floor and decrease the thermal efficiency of the cargo container. In addition, the floor typically has a series of structural members located on the under surface of the floor, which are also constructed of metal. These structural members also contribute to the heat loss through the floor and further decrease the thermal efficiency of the cargo container.

Therefore, there is a need for an insulated floor for a cargo container with increased thermal efficiency.

II. SUMMARY

An apparatus consistent with the present invention provides an insulated floor for a cargo container comprising a floor panel having a bottom surface; at least one insulating member having a top and bottom surface, the top surface attached to the bottom surface of the floor panel; and at least one structural member, each structural member having a top surface, the top surface attached to the bottom surface of at least one insulating member.

An apparatus consistent with the present invention also provides an insulated floor for a cargo container comprising a floor panel having a bottom surface; at least one insulating member having a top and bottom surface, the top surface attached to the bottom surface of the floor panel; an insulation layer comprising a top surface and a bottom surface and located on the bottom surface of the floor panel and wherein the combination of the insulation layer and the at least one insulation member substantially covers the bottom surface of the floor panel; at least one structural member having a top surface and a bottom surface, wherein the top surface is attached to the bottom surface of the insulating member; and a second insulation layer located on and substantially covering the at least one structural member.

An apparatus consistent with the present invention further provides an insulated floor for a cargo container comprising a floor panel having a longitudinal axis, a bottom surface, and a first end and a second end opposite said first end; a plurality of insulating members having a top and bottom surface, the top surface attached to the bottom surface of the floor panel; an insulation layer comprising a top surface and a bottom surface, wherein the top surface is located on the bottom surface of the floor panel and wherein the combination of the insulation layer and the insulating members substantially covers the bottom surface of the floor panel; a first side sill attached to said insulation layer at the first end of the floor panel and having an interior surface; a second side sill attached to said insulation layer at the second end of the floor panel and having an interior surface; a sill substantially centered about the floor panel and aligned along the longitudinal axis of the floor panel and having a top and bottom surface, the top surface attached to the bottom surface of at least one of the insulating members; a plurality of I-Beams aligned along the longitudinal axis of the floor panel and having a top and bottom surface, the top surface of each I-Beam being attached to the bottom surface of an insulating member; and a second insulation layer substantially covering the center sill, the plurality of I-Beams, and the interior surfaces of the first side sill and the second side sill.

Additional objects and advantages of the invention will be set forth in part in the description which follows, and in part will be obvious from the description, or may be learned by practice of the invention. The objects and advantages of the invention will be realized and attained by means of the elements and combinations particularly pointed out in the appended claims.

It is to be understood that both the foregoing general description and the following detailed description are exemplary and explanatory only and are not restrictive of the invention, as claimed.

The accompanying drawings, which are incorporated in and constitute a part of this specification, illustrate one embodiment of the invention and together with the description, serve to explain the principles of the invention.

III. BRIEF DESCRIPTION OF THE DRAWINGS

V. DESCRIPTION OF THE EMBODIMENTS

A. Introduction

Apparatus consistent with the present invention will now be described with respect to an embodiment of an insulated cargo container, or a boxcar. The invention as claimed, however, is broader than boxcars and extends to other large insulated cargo containers, such as, shipping containers used on seagoing container vessels, truck trailers, straight trucks, refrigerated buildings, or the like.

B. Apparatus

Figure 1:
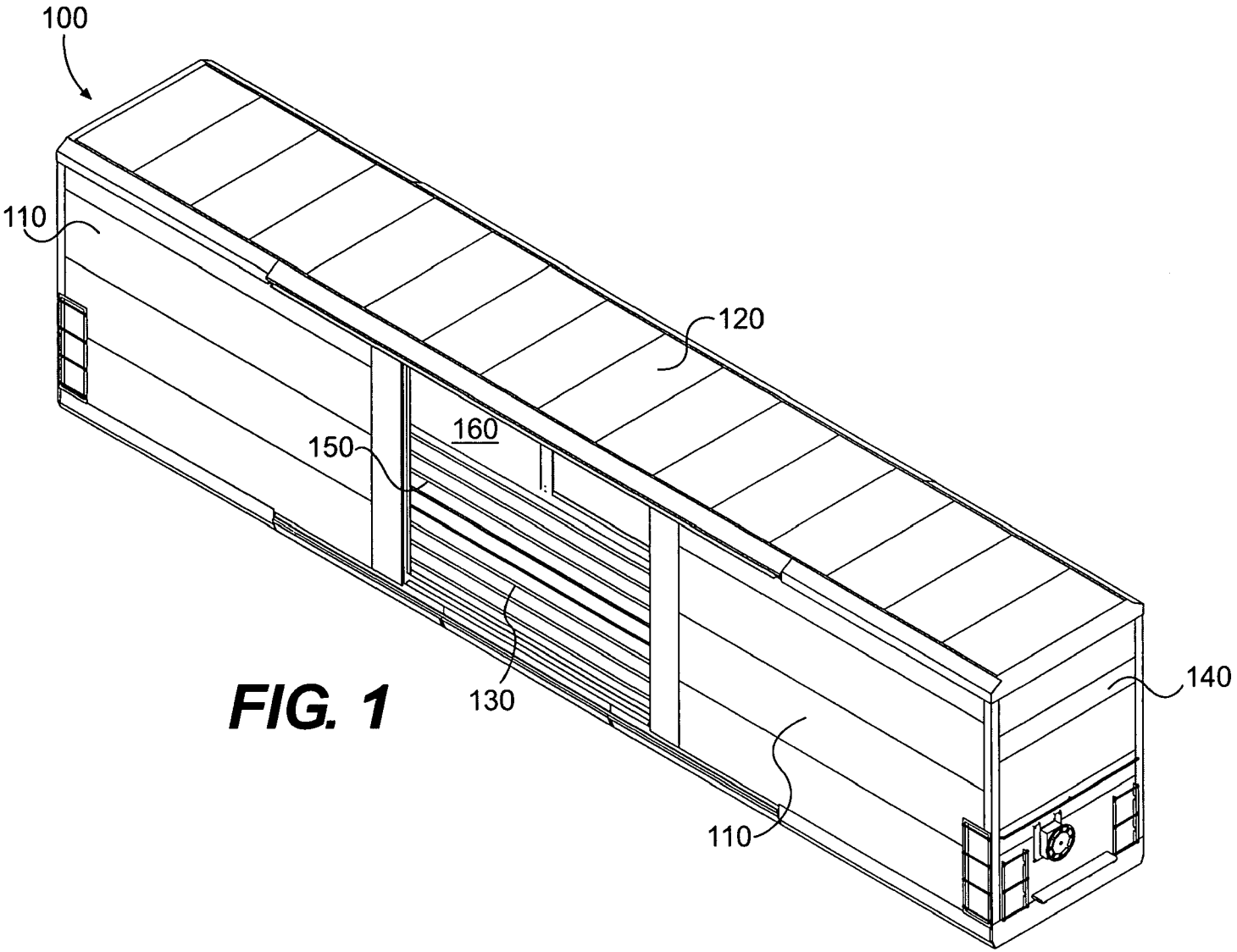
FIG. 1 is an isometric view of an insulated boxcar consistent with one embodiment of the invention.
Figure 2:
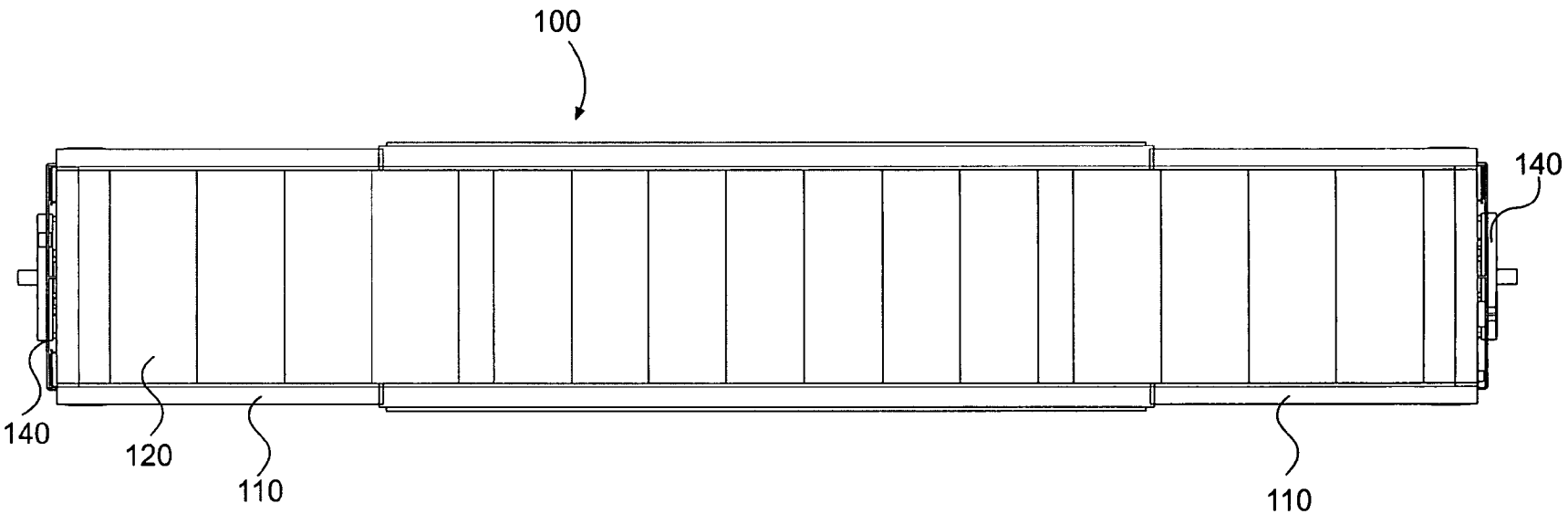
FIG. 2 is a top view of an insulated boxcar consistent with one embodiment of the invention.
Figure 3:
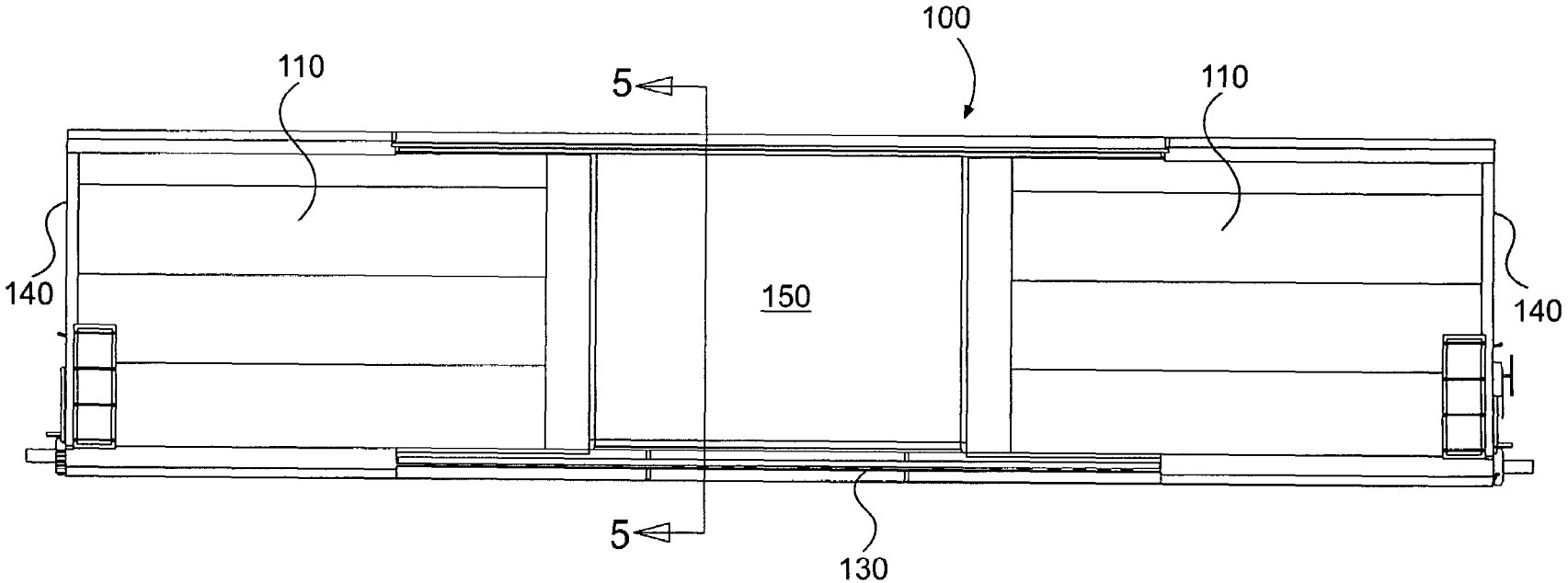
FIG. 3 is a side view of an insulated boxcar consistent with one embodiment of the invention.

FIGS. 1-3 illustrate three views of an insulated boxcar consistent with one embodiment of the invention. As shown in FIGS. 1-3, an insulated boxcar 100 includes wall panels 110, a roof 120, a floor 130, end walls 140, and a door opening 150. Wall panels 110, roof 120, floor 130, and end walls 140 combine to form an enclosure 160. Door opening 150 provides access to enclosure 160. Enclosure 160 can be used to store articles at specified temperatures. In one implementation, boxcar 100 will include a refrigeration mechanism to maintain a specified temperature in enclosure 160.

As described above, the thermal efficiency of boxcar 100 depends, in part, on the construction of wall panels 110, roof 120, floor 130, and end walls 140. Implementations of floor 130 consistent with the present invention are described in detail below with respect to FIGS. 4-6. This implementation of floor 130 provides for a higher R-value than prior systems.

Figure 4:
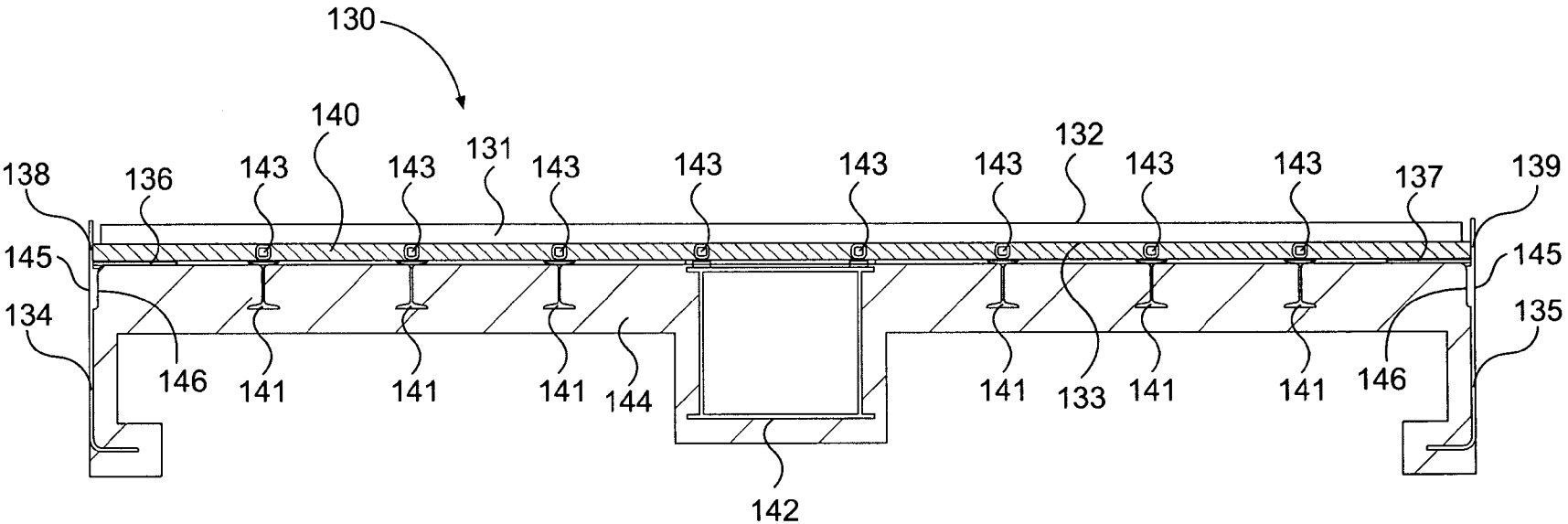
FIG. 4 is a cross-sectional schematic view of an insulated floor of an insulated boxcar consistent with one embodiment of the invention.

FIG. 4 is a cross-sectional schematic view of an insulated floor of an insulated boxcar consistent with one embodiment of the invention. As shown in FIG. 4, insulated floor 130 comprises a floor panel 131, which preferably forms the floor of a cargo container. Floor panel 131 has a top surface 132 and a bottom surface 133. Top surface 132 forms the interior floor surface of enclosure 160. In prior systems, bottom surface 133 would form the outer surface of the cargo container.

Floor panel 131 may be of any size or construction suitable to form a floor of a cargo container. For example, in one implementation, floor panel 131 comprises one panel, which extends the length and width of the cargo container. In another implementation, floor panel 131 comprises multiple sections, which when connected to one another, will generally extend the length and width of the cargo container. In this implementation, the multiple panels may be connected by mechanical fasteners, interlocking edges, adhesives, or welding. The thickness of floor panel 131 can vary, and should be suitable to support the weight of the cargo to be held in the cargo container. Typically, floor panel 131 will be constructed of a metal, such as steel, however, other materials may be used. These implementations are merely exemplary, and other implementations may also be used.

As shown in FIG. 4, insulated floor 130 also includes side sills 134 and 135. Side sills 134 and 135 are located at opposing sides of floor panel 131 and extend longitudinally along floor panel 131. In addition, side sills 134 and 135 provide structural support for floor panel 131. In one implementation, side sills 134 and 135 are constructed of a metal, such as steel, however other materials may be used.

As shown in FIG. 4, in one implementation, side sills 134 and 135 have vertical members 138 and 139. Vertical members 138 and 139 may connect to wall panels (not shown) of the boxcar. In this implementation, vertical members 138 and 139 may be connected to wall panels by mechanical fasteners, adhesives, or welding. Side sills 134 and 135 also have exterior surfaces 145, which form an exterior surface of the boxcar and interior surfaces 146 opposing the exterior surfaces 145. In addition, side sills 134 and 135 have flanges 136 and 137, which extend under floor panel 131. Flanges 136 and 137 provide structural support to floor panel 131. This implementation is merely exemplary, and other side sills may be used.

In prior systems, bottom surface 133 of floor panel 131 would be exposed to ambient conditions thereby resulting in heat loss across floor panel 131. In addition, bottom surface 133 would also typically rest on flanges 136 and 137. Since exterior surfaces 145 and interior surfaces 146 of side sills 134 and 135 are also exposed to ambient conditions, this would result in further heat loss. Therefore, in one implementation, insulated floor 130 includes an insulation layer 140.

In one implementation, insulation layer 140 is located on at least a portion of bottom surface 133 of floor panel 131 in order to reduce heat loss through floor panel 131. In another implementation, as shown in FIG. 4, insulation layer 140 is also located between flanges 136 and 137 and floor panel 131. In this implementation, insulation layer 140 removes a thermal short between side sills 134 and 135 and floor panel 131, thereby reducing heat loss. A thermal short in an insulated enclosure is an area where heat loss can bypass insulation and thereby reduce the thermal efficiency of the enclosure. These implementations are merely exemplary and other implementations may also be used.

Insulation layer 140 may be comprised of any material capable of acting as an insulator. In one implementation, insulation layer 140 is comprised of a foam insulation, such as urethane. In addition, insulation layer 140 may be adhesively bonded to floor panel 131. In one implementation, a structural adhesive, such as Pliogrip 7700 available from Ashland Specialty Chemical Company is used. This implementation is merely exemplary and other implementations may also be used.

In another implementation, insulation layer 140 would be comprised of one or more composite panels. The composite panel or panels may be continuously formed, vacuum infused or formed by any other suitable method. In one implementation, the composite panel would have sufficient structural strength to support any load on floor panel 131. In another implementation, flanges 136 and 137 would further support the composite panel. These implementations are merely exemplary and other implementations may also be used.

As shown in FIG. 4, insulated floor 130 may also include structural members. Structural members are members which provide structural support to floor panel 131 by supporting some portion of the load applied to floor panel 131. I-Beams 141 and center sill 142 are examples of such structural members. Center sill 142 is the main longitudinal structural member of a boxcar underframe. I-Beams 141 provide further structural support to the boxcar underframe. Structural members may comprise a single component or be comprised of multiple components that when combined form a single structural member.

As shown in FIG. 4, center sill 142 is substantially centered on and extends longitudinally under the undersurface of floor panel 131. As further shown in FIG. 4, I-Beams 141 also extend longitudinally under the undersurface of floor panel 131 and are located on either side of center sill 142. While FIG. 4 depicts six (6) I-Beams 141, any number of I-Beams may be used. Center sill 142 and I-Beams 141 may be constructed of any material, such as metals, composites, polymers, or any combination thereof, and in any shape so as to provide support for the boxcar underframe. These implementations are merely exemplary and other implementations may also be used. For example, the boxcar may have a plurality of sills in various positions. In addition, the sills or I-Beams may extend across the width of the boxcar underframe rather than longitudinally.

In another embodiment of the invention, at least one of structural members 141 or sills 142, 134 and 135 are made of fiber reinforced plastic. Where the structural members 141 or sills 142, 134 and 135 are made of fiber reinforced plastic, insulating member 143 may be removed. Additionally, it is possible to remove one of the insulation 144 or insulation layer 140 and still meet an objective of the invention as long as no thermal short is created in the removal.

In prior systems, center sill 142 and I-Beams 141 would typically be constructed of steel and welded to floor panel 131. As described above, since center sill 142 and I-Beams 141 are exposed to ambient conditions, this would result in a thermal short and a subsequent heat loss through floor panel 131. Therefore, in one implementation, as shown in FIG. 4, insulated floor 130 includes insulating members 143.

Insulating members 143 are connected to floor panel 131 and the structural members. For example, in the implementation shown in FIG. 4, insulating members 143 are connected to the top surfaces of center sill 142 and I-Beams 141 and bottom surface 133 of floor panel 131, thereby removing the thermal shorts. Insulating members 143 may be constructed of any material including composites or wood and in any shape suitable to reduce heat loss from the connection of structural members, such as center sill 142 and I-Beams 141 to floor panel 131. As shown in FIG. 4, insulating members 143 may be located between each structural member (i.e., center sill 142 and I-Beams 141) and floor panel 131. Alternatively, insulating members may only be located between certain structural members. These implementations are merely exemplary and other implementations may also be used.

In one implementation, as shown in FIG. 4, insulating members 143 have a generally square-shaped cross-section and extend longitudinally under the undersurface of floor panel 131. Insulating members 143 may be the same length as, shorter than, or longer than the member to which they are attached (either center sill 142 or I-Beams 141). In one implementation, insulating members 143 are constructed of fiber-reinforced plastics and attached to center sill 142 or I-Beams 141 and bottom surface 133 with a structural adhesive, such as Pliogrip 7700. These implementations are merely exemplary and other implementations may also be used. For example, insulating members with generally U-shaped cross sections may be used. In addition, other means of attaching the insulating members may be used such as bolts or other mechanical fasteners.

In one implementation, insulation layer 140 and insulating members 143 extend over substantially all of the bottom surface of floor panel 131. In this implementation, since no portion of floor panel 131 is exposed to ambient conditions, the thermal efficiency of the cargo container is improved. Moreover, to the extent that structural members such as side sills 134 and 135, I-Beams 141, or center sill 142 are exposed to ambient conditions, thermal shorts have been removed between those members and the floor panel 131 by using insulation layer 140 and insulating members 143. Therefore, thermal efficiency is still further improved.

In the implementation described above, since side sills 134 and 135, I-Beams 141, or center sill 142 may still be exposed to ambient conditions, some heat loss still exists. In order to reduce this heat loss and further improve thermal efficiency, as shown in FIG. 4, insulated floor 130 includes insulation layer 144.

In one implementation, insulation layer 144 is located on the undersurface of insulation layer 140 and substantially surrounds I-Beams 141 and center sill 142. In addition, insulation layer 144 also cover a substantial portion of the interior surfaces 146 of side sills 134 and 135. Insulation layer 144 may be comprised of any material capable of acting as insulator. In one implementation, insulation layer 144 comprises foam insulation, such as urethane. In addition, insulation layer 144 may be adhesively bonded to the interior surfaces of side sills 134 and 135, I-Beams 141, and center sill 142. In one implementation, a structural adhesive, such as Pliogrip 7700 available from Ashland Specialty Chemical Company is used. This implementation is merely exemplary and other implementations may also be used.

Figure 5:
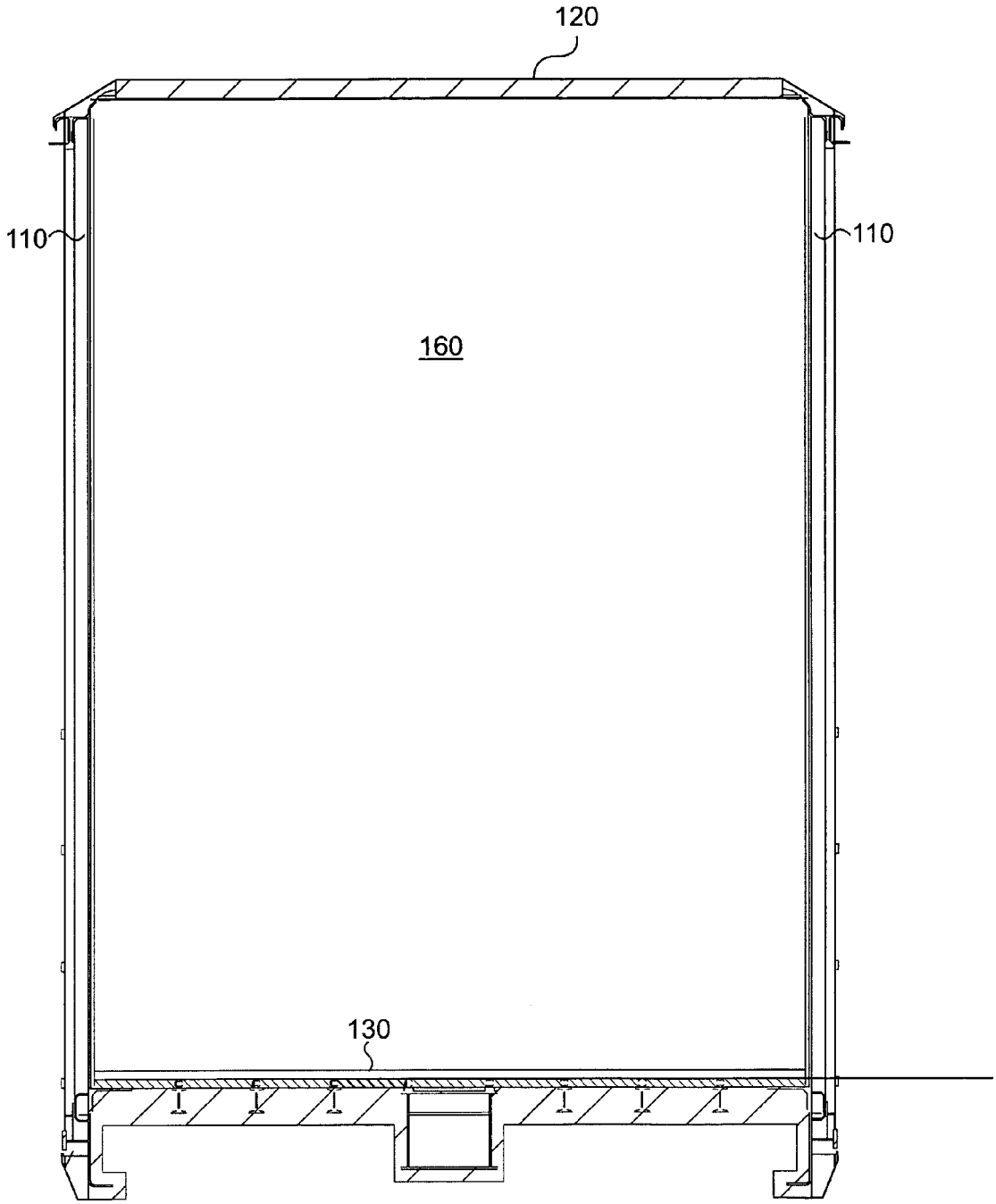
FIG. 5 is a cross-sectional view of an insulated boxcar consistent with one embodiment of the invention taken along line 5-5 of FIG. 3.

FIG. 5 is a cross-sectional view of a cargo container consistent with one embodiment of the invention taken along line 5-5 of FIG. 3. As shown in FIG. 5, insulated floor 130 combines with side panels 110 and roof 120 to form enclosure 160.

Figure 6:
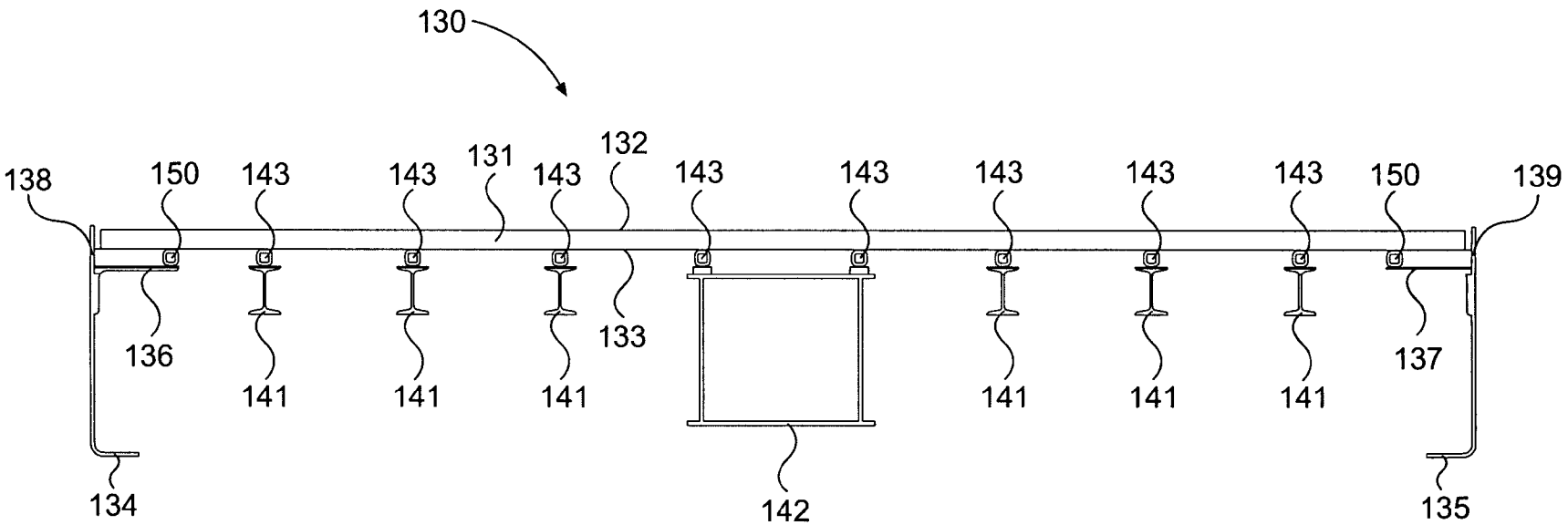
FIG. 6 is a cross-sectional schematic view of an insulated floor of an insulated boxcar consistent with another embodiment of the invention.

FIG. 6 is a cross-sectional schematic view of an insulated floor of an insulated boxcar consistent with another embodiment of the invention As shown in FIG. 6, insulated floor 130 is the same as that depicted in FIGS. 4-5, except insulated floor 130 does not have insulation layers 140 and 144. In addition, additional insulating members 150 are included between flanges 136 and 137 and floor panel 131. In this implementation, insulating members 150 remove the potential thermal shorts between side sills 134 and 135 and floor panel 131. This implementation is merely exemplary and other implementations may also be used.

It should be understood that the implementations described above may be used both to create a new insulating floor for a boxcar or to modify an existing floor of a boxcar. In addition, the insulation described above could also be used for electrical insulation in addition to thermal insulation.

Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

What is claimed is:

1. An insulated floor for a cargo container comprising:

a floor panel having a longitudinal axis, a bottom surface, and a first end and a second end opposite said first end;

a plurality of insulating members having a top and bottom surface, the top surface attached to the bottom surface of the floor panel;

a first insulation layer comprising a top surface and a bottom surface, wherein the top surface is located on the bottom surface of the floor panel and wherein the combination of the first insulation layer and the insulating members substantially covers the bottom surface of the floor panel;

a first side sill attached to said first insulation layer at the first end of the floor panel and having an interior surface;

a second side sill attached to said first insulation layer at the second end of the floor panel and having an interior surface;

a sill substantially centered about the floor panel and aligned along the longitudinal axis of the floor panel and having a top and bottom surface, the top surface attached to the bottom surface of at least one of the insulating members;

a plurality of I-Beams aligned along the longitudinal axis of the floor panel and having a top and bottom surface, the top surface of each I-Beam being attached to the bottom surface of an insulating member; and a second insulation layer substantially covering the exposed surfaces of the center sill, the plurality of I-Beams, and the inward-facing exposed surfaces of the first side sill and the second side sill.

2. The insulating floor of claim 1 wherein the plurality of insulating members are fiber-reinforced plastics.

* * * * *